United States Patent [19]

Tanikuro et al.

[11] Patent Number: 4,809,458

[45] Date of Patent: Mar. 7, 1989

[54] SELF-LUMINOUS BUOY

[75] Inventors: Hideo Tanikuro; Kimiaki Nagamatsu, both of Shimonoseki, Japan

[73] Assignee: Nichimo Co., Ltd., Tokyo, Japan

[21] Appl. No.: 18,088

[22] Filed: Feb. 24, 1987

[30] Foreign Application Priority Data

Feb. 25, 1986 [JP] Japan ..... 61-25220

[51] Int. Cl.[4] ..... A01K 85/00

[52] U.S. Cl. ..... 43/17.5; 136/291

[58] Field of Search ..... 43/17.5, 43.1, 17.6; 136/291; 441/15, 16

[56] References Cited

U.S. PATENT DOCUMENTS

| | | | |
|---|---|---|---|
| 3,041,771 | 7/1962 | Hreno | 43/17.5 |
| 3,693,278 | 9/1972 | Mahone | 43/17.5 |
| 4,516,349 | 5/1985 | Klocksiem | 43/17.5 |
| 4,626,852 | 12/1986 | Dodge | 136/291 |

OTHER PUBLICATIONS

"Applied Solar Energy", Pul'manov et al., vol. 10, No. 3, pp. 23–27, 1974.

*Primary Examiner*—M. Jordan
*Assistant Examiner*—Karen Skillman

[57] ABSTRACT

A self-luminous buoy thereof comprises a solar generator, a battery for storing therein the electrical energy generated by said solar generator, a light emitting element which emits the light by the energy supplied from the storage battery and an energy control means which permits the supply of the electrical energy from said storage battery and an energy control means which permits the supply of the electrical energy from said storage battery to said light-emitting element only when illumination drops below a predetermined level.

2 Claims, 3 Drawing Sheets

SELF-LUMINOUS BUOY

FIELD OF THE INVENTION

The present invention relates to self-luminous buoys used with fishing tackle.

BACKGROUND OF THE INVENTION

In the case of the uses of fishing nets such as purse seines, towing nets, stationary nets, gill nets, longlines, nets used to define fish preserve or culture and so on, in general, buoys are fastened to predetermined positions of the fishing nets in order to identify the positions of the fishing nets and to maintain the fishing nexts in water in a desired shape.

In order to enable the visual perception of such buoys at night, reflecting elements are attached to the surfaces of the buoys or storage type fluorescent materials are coated over the surfaces of the buoys.

However, the buoys with the reflecting elements attached to the surfaces thereof have the following problems.

That is, the reflecting elements are only bonded to the surfaces of the buoys, they tend to be easily separated from the buoys when the buoys are thrown into water and when they collide against the hull of the ship vessels as they are retrieved on the ships or against drifts. They are also separated due to friction. Furthermore, in order to visually perceive such buoys, light sources must be provided in order to emit the light rays which in turn are reflected by the reflecting elements. In addition, the visual perception distance is limited by the capacity or intensity of the light sources. Moreover, when the buoys move or the ships pitch, roll and rock, it becomes impossible to correctly strike the light rays against the reflecting elements so that it sometimes becomes very difficult to find out the buoys with the reflecting elements.

Meanwhile, the storage-fluorescent-material coated buoys also have some problems to be described below.

That is, since the fluorescent materials are only coated over the surfaces of the buoys, they also tend to be separated as in the case of the buoys with the reflecting elements. Furthermore, in order to store the energy into the fluorescent materials, the light sources are also needed. In addition, their light-emission time is short and its maximum luminance is low so that the distance at which the buoys can be perceived is extremely limited. Moreover, their luminance decreases as time elapses so that it becomes difficult to perceive them. The luminance of a fluorescent material is in general in proportion to the intensity of light emitted from a light source so that when the light rays are emitted from a distance spaced by some distance from a buoy in order to make the luminance of the buoys perceivable, a light source having a relatively high light-emitting capacity is needed. As a result, the cost is increased and a light source used is increased in size the weight so that a relatively large space for installation of a light source must be provided on a ship.

BRIEF SUMMARY OF THE INVENTION

In view of the above, one of the objects of the present invention is to provide a self-luminous buoy which can substantially solve the above described technical problems by rational means and which automatically emits light when the luminance drops below a predetermined level at night or at any other time.

Another object of the present invention is to provide a self-luminous buoy which can be perceived at a high degree of probability under any conditions such as fishing conditions, weather conditions and so on.

A further object of the present invention is to provide a self-luminous buoy which can eliminate the use of a light source for enabling the buoy to be perceived so that the energy saving can be attained and also the human energy can be reduced in the case of seeking the buoys.

In order to attain the above and other objects of the present invention, a self-luminous buoy thereof comprises a solar generator, a battery for storing therein the electrical energy generated by said solar generator, a light-emitting element which emits the light by the energy supplied from the storage battery and an energy control means which permits the supply of the electrical energy from said storage battery to said light-emitting element only when illumination drops below a predetermined level.

Since the self-luminous buoy in accordance with the present invention has the construction described above, when the surrounding illumination drops below a predetermined level, the energy control means electrically energizes both the storage battery and the light-emitting element so that the electrical energy which is generated by the solar generator and is stored in the storage battery is supplied to the light-emitting element so that the latter emits the light.

As described above, the self-luminous buoy in accordance with the present invention emits the light when the surrounding illumination drops below a predetermined level so that it can be perceived under any operating conditions with a high degree of probability. The self-luminous buoy in accordance with the present invention eliminates the use of a light source for discriminating the buoys so that the self-luminous buoys which move relative to a ship can be easily perceived. As a result, both the energy and labor savings can be attained.

DETAILED DESCRIPTION OF THE PREFERRED EMBODIMENTS

The preferred embodiments of the present invention will be described in detail with reference to FIGS. 1–12.

Figure 1:
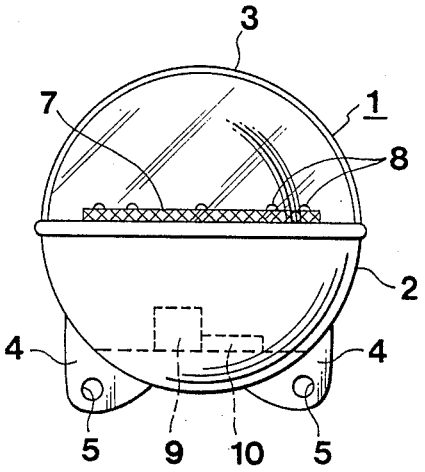
FIG. 1 is a front view of a first embodiment of a self-luminous buoy in accordance with the present invention.
Figure 3:
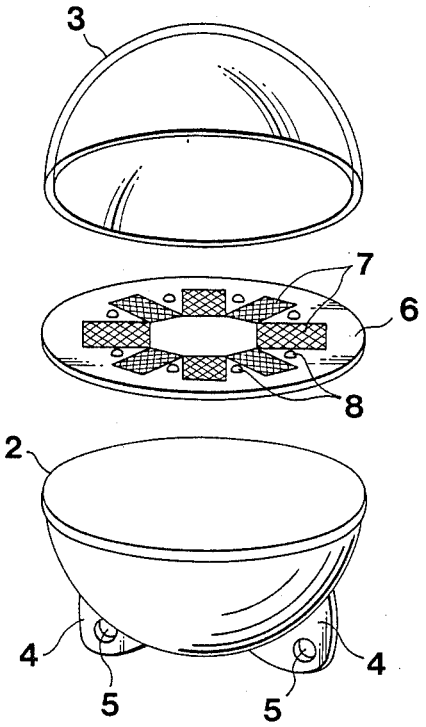
FIG. 3 is an exploded perspective view thereof.
Figure 2:
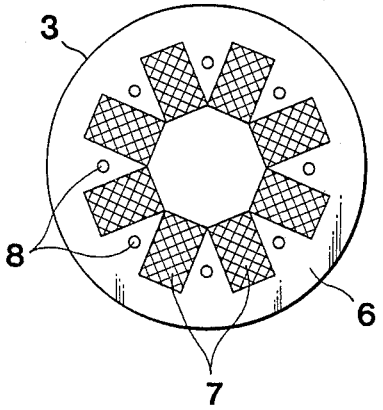
FIG. 2 is a top view thereof.

FIGS. 1-3 show a first embodiment of the present invention.

In FIG. 1, reference numeral 1 denotes a hollow spherical buoy main body consisting of an upper semispherical portion 3 and a lower semispherical portion 2 which are joined integrally as best shown in FIG. 3. The lower semispherical portion 2 is integrally formed from a synthetic resin or made of a metal. Projections 4 each having a fastening hole 5 for fastening the buoy main body 1 to a fishing next or the like are extended from the lower portion of the lower semispherical portion 2. The upper semispherical portion 3 is integrally formed from a transparent synthetic resin so that the solar light can be transmitted through the upper semispherical portion 3 into the interior of the self-luminous buoy. A disk-shaped base 6 is disposed within the buoy main body 1 and is securely clamped between the lower and upper semispherical portions 2 and 3. A plurality of solar generators 7 (eight generators in this embodiment) are disposed and radially extended on the upper surface of the base 6 and light-emitting elements 8 such as light-emitting diodes are interposed between the adjacent solar generators 7. Therefore, as shown in FIGS. 1 and 2, the solar energy is transmitted through the transparent upper semispherical portion 3 to fall on the solar generators 7 and the light emission of all the light-emitting elements 8 can be perceived from the exterior of the upper semispherical portion 3. A storage battery 9 for storing therein the electrical energy generated by the solar generates 7 is disposed within the lower semispherical portion 2 below the base 6 as best shown in FIG. 1. In the first embodiment, the storage battery 9 comprises a small-sized seal lead storage battery. The electric power generation capacity of the solar generators 7 and the quantity of the electric energy stored in the storage battery 9 are so determined that they are in excess of the consumption of the energy by all the light-emitting elements 8 during one night. Disposed in the semispherical portion 2 is an energy control unit 10 which permits the supply of electrical energy from the storage battery 9 to respective light-emitting elements 8 only when the illumination outside of the buoy main body 1 drops below a predetermined level at night or at another other time. The energy control unit 10 can be designed and constructed from various electrical component parts such as a light sensor, a switching element and so on. As a whole, the self-luminous buoy in accordance with the present invention is so designed and constructed to have a sufficient degree of buoyancy.

Next the mode of operation of the first embodiment with the above-described construction will be explained below.

For instance, a large number of self-luminous buoys in accordance with the present invention are fastened to a purse seine, a towing net, a gill net or longline by fastening the projections 4 of each self-luminous buoy main body 1 to the fishing net with the fine strings.

In each self-luminous buoy thus fastened, each solar generator 7 receives the solar energy transmitted through the upper transparent semispherical portion 3 during the day time and converts it into the electrical energy which in turn is stored in the storage battery 9. When the illumination outside of each self-luminous buoy main body 1 drops below a predetermined level at night or another other time, the energy control unit 10 permits the supply of the electrical energy to respective light-emitting elements 8 so that the latter emit the light through the buoy main body 1 to the outside.

Therefore when the self-luminous buoys fastened to a gill net or longline are thrown into the water in such a way that the upper semispherical portions 3 thereof are exposed above the water surface, each light-emitting element 8 automatically emits the light at night by converting the electrical energy stored during the day time in the manner described above so that the position and shape of the fishing net can be easily perceived during the dark time. Furthermore, even in case of the fishing operation at night by throwing a purse seine which has been disposed on the deck of a ship during the day-time, the position and shape of the expanded purse net with the self-luminous buoys can be easily perceived so that the safe and rapid fishing operation can be carried out.

When the self-luminous buoys are fastened to the floating net or otter boards, the positions of the net and otter boards can be detected by seeking the light-emitting elements 8 which emit the light at night when the net is drawn so that the net and the otter boards can be safely and rapidly drawn on the deck of the ship.

Furthermore, when the self-luminous buoys are fastened to a stationary fishing net, a net extended for fish culture or a raft for sea weed or pearl culture in such a way that the upper semispherical portion 3 of each buoy main body 1 is exposed above the water surface, the solar generators 7 receive the solar energy and convert it into the electrical energy which in turn is stored in the storage battery 9 during the day-time and when the sun falls, the energy control unit 10 is actuated so that the light-emitting elements 8 automatically emit the light. Because of the light rays emitted from the light-emitting elements 8, the position, extension and shape of the fishing tackle can be easily perceived from the deck of the ship so that the collision of the ship with the fishing tackle and the crossing the fishing tackle by the fishing boat can be prevented. As a result, damages to the fishing tackle can be prevented.

When the self-luminous buoys which can automatically emit the light at night at described above are fastened to the sleeve nets and otter boards of a towing net, it can be prevented by the intermediating effect attained by the emission of light from the light-emitting elements 8 that fish escapes through the mesh of the towing net or it is trapped by the mesh.

Furthermore, the self-luminous buoys fastened to the floating lines of a fence net of a fixed or stationary fishing net automatically emit light at night so that the emitted light serves to collect and guide fish.

In the first embodiment, the electrical energy stored in the storage battery 9 is sufficient enough to cause all the light-emitting elements 8 to emit the light during the whole night and the intensity of light emitted from each self-luminous buoy is sufficiently high so as to permit the easy detection of the buoys. As a result, unlike the prior art fishing operations, the light source for visually detecting the buoys at night can be eliminated, whereby the energy and labor savings can be attained.

The self-luminous buoy of the first embodiment of the present invention is in the form of an integral ball so that there is no fear that it tangles with the fishing net. Furthermore, it can be easily handled. In addition, the solar generators 7, the light-emitting elements 8, the storage battery 9 and the energy control unit 10 are housed within the strong or rugged buoy main body 1 so that even when the fishing boat strikes the buoy main body 1, the component parts housed in it are prevented from being damaged. During the day-time, the solar energy is converted into the electrical energy and stored and during the night the light-emitting elements 8 continue to emit the light. Furthermore the self-luminous buoy in accordance with the present invention has a high degree of durability so that it can be used for a long period of time.

Figure 4:
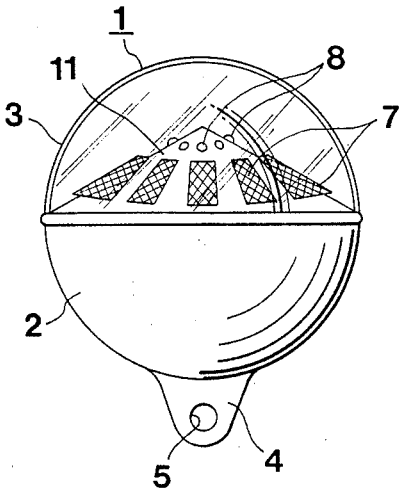
FIG. 4 is a front view of a second embodiment of the present invention.
Figure 5:
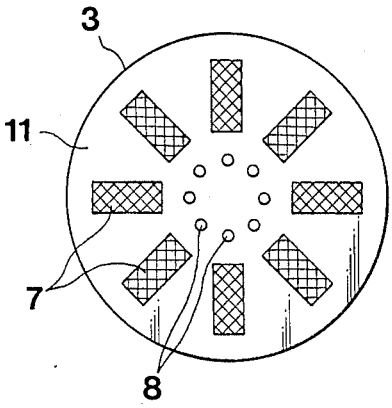
FIG. 5 is a top view thereof.

FIGS. 4 and 5 show a second embodiment of the present invention which is substantially similar in construction to the first embodiment described with reference to FIGS. 1–3 except that instead of the flat base 6, a conical reflecting plate 11 is disposed within the self-luminous buoy main body 1 and only one projection 4 with a fastening hole 5 is extended from the lower semispherical portion 2. Eight equiangularly spaced apart light-emitting elements 8 are disposed adjacent to the top or vertex of the reflecting plate 11 while eight equiangularly spaced apart solar generators 7 are disposed radially at the skirt portion of the conical reflecting plate 11.

According to the second embodiment with the abovedescribed construction, the electrical energy is automatically generated and stored during the day-time and the light is automatically emitted during the night. In addition, because of the provision of the conical reflecting plate 11, the visual perceptivity can be improved both during the day-time and night.

Figure 6:
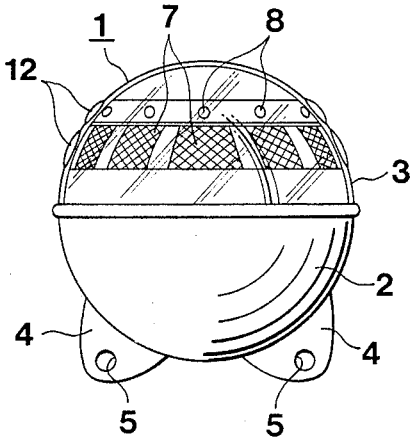
FIG. 6 is a front view of a third embodiment of the present invention.
Figure 7:
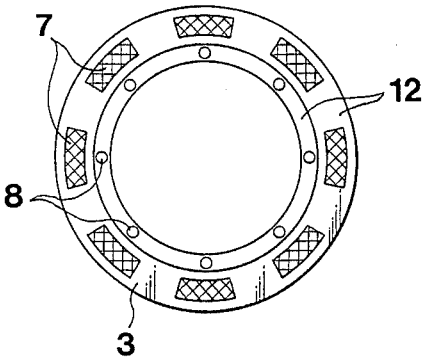
FIG. 7 is a top view thereof.

FIGS. 6 and 7 show a third embodiment of the present invention which is substantially similar in construction to the first embodiment described above except that annular lenses 12 are defined at suitable positions of the upper transparent semispherical portion 3 and that eight solar generators 7 and eight light-emitting elements 8 are disposed inside the lenses 12.

According to the third embodiment with the abovedescribed construction, because of the solar energy collection ability of the lenses 12, the electrical energy generated by each solar generator 7 is increased and furthermore the light beam emitted from each light-emitting element 8 can be converged or diverged during the night so that the visual perceptivity can be also improved.

Figure 8:
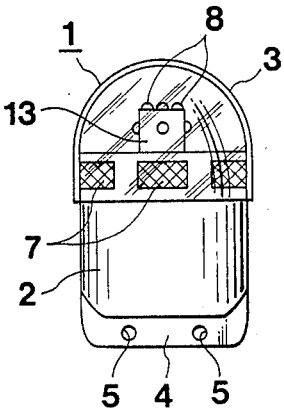
FIG. 8 is a front view of a fourth embodiment of the present invention.
Figure 9:
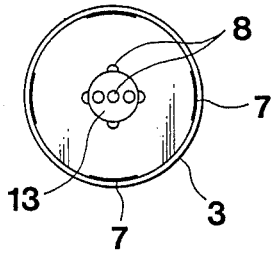
FIG. 9 is a top view thereof.

FIGS. 8 and 9 show a fourth embodiment of a self-luminous buoy in accordance with the present invention. In the fourth embodiment, the self-luminous buoy is in the form of a cylinder as a whole and the solar generators 7 are disposed at the outer cylindrical surface of the lower cylindrical portion 2 so as to be exposed to the exterior. A plurality of light-emitting elements 8 are mounted on a socket 13 disposed in the upper transparent dome-shaped upper portion 3 coaxially thereof. The upper transparent dome-shaped portion 3 serves as a lens and the lower cylindrical portion of the upper section 3 covers and protects the solar generators 7.

In the above-described embodiments, the upper half portion 3 through which is emitted the light to the exterior may be made of a material which transmits the colorless light or any desired colored light. In addition, the color of the light emitted from the light-emitting element 8 itself may be suitably varied.

Figure 10:
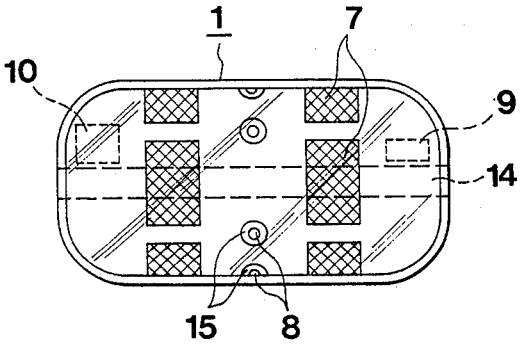
FIG. 10 is a side view of a fifth embodiment of the present invention.
Figure 11:
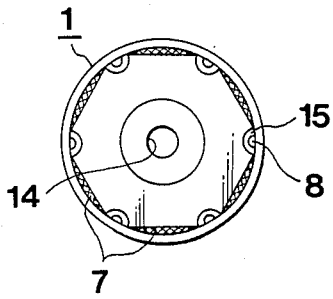
FIG. 11 is a right side view thereof.

FIGS. 10 and 11 show a fifth embodiment of the present invention. The self-luminous buoy main body 1 of the fifth embodiment is in general in the form of a cylinder with a through hole 14 extended coaxially thereof in such a way that a floating net or a fine fastening string can be extended therethrough. A plurality of solar generators 7 are securely attached to the outer cylindrical surface of the buoy main body 1. In like manner, a plurality of light-emitting elements 8 are securely attached to the outer cylindrical surface of the buoy main body 1 and are surrounded the light reflecting plates 15, respectively. The whole outer surface of the buoy main body 1 including the solar generators 7 and the light-emitting elements 8 is covered with a transparent protective cover 16.

Figure 12:
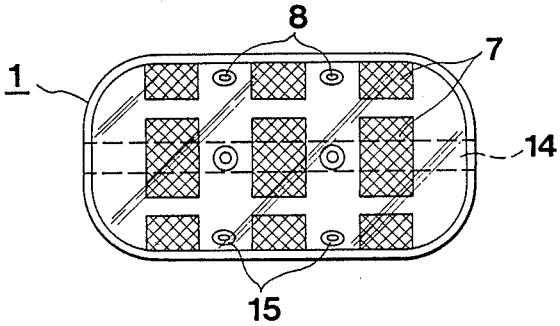
FIG. 12 is a side view of a sixth embodiment of the present invention.

FIG. 12 shows a sixth embodiment of the present invention which is substantially similar in construction to the fifth embodiment described above with reference to FIGS. 10 and 11 except that the solar generators 7 and the light-emitting elements 8 are greater in number than those of the fifth embodiment.

In the cases of the fifth and sixth embodiments of the present invention, a fine fastening string or a floating net can be extended through the through hole 14 so that a large number of self-luminous buoys can be continuously fastened to a single line. Since the more than halt upper section of the buoy main body 1 is exposed above the water surface so that the sufficient electrical energy can generated by the solar generators 7. In like manner, a large number of light-emitting elements 8 are exposed above the water surface so that the visual perceptivity can be enhanced. In addition, the reflector 15 reflects back to the exterior the light emitted from the light-emitting element 8 so that the visual perceptivity can be further improved.

The solar generators 7 and the light-emitting elements 8 may be embedded into the outer peripheral surface of the buoy main body 1 so that they are prevented from directly striking against the hull of the ship. Alternatively, they may be exposed out of the outer peripheral surface of the buoy main body 1.

In addition to the shapes of the self-luminous buoys described above, they may be in any desired form of a body of revolution such as an elliptical body, an inverted cone or the like. Alternatively, they may be in the form of a polyhedron.

It is to be understood that the present invention is not limited to the embodiments described above and that various modifications can be effected as needs demand.

What is claimed is:

1. In a self-luminous buoy including:

a. a generally spherical buoy main body;

b. a plurality of solar cells positioned as an annular array about a vertical axis of said body and above the equator of said body, for generating electricity when contacted by sunlight, located on an outwardly facing surface of said body;

c. a battery, within said body, for storing electrical energy generated by said solar cells;

d. light-emitting elements energized by electrical energy from said battery, for emitting light and thereby making said buoy luminous, positioned as a second annular array, respecting a vertical axis of said body, above the equator of said body;

e. means, within said buoy main body, for providing electrical energy from said battery to said light-emitting elements upon ambient light reaching a predetermined low level;

f. a transparent frusto-spherical synthetic resin shell about said body in the area of said light emitting means and said solar cells, above the equator of said body;

the improvement comprising:

g. a pair of ring-like lenses which are annular respecting said vertical axis of said body and positioned above the equator of said body, on and essentially coplanar with said frusto-spherical shell, being optically aligned with said light emitting means and said solar cells respectively in a manner that light emitted by said light emitting means to make said buoy luminous passes through one of said lenses and sunlight reaching said solar cells passes through another of said lenses;

h. said annular lens through which said light emitted by said light emitting means passes dispersing said light so that the visual perception of said buoy is improved; and i. said lens through which said sunlight passes to reach said solar cells collecting and concentrating said sunlight on said solar cells to increase solar energy input to said solar cells and hence to increase electrical energy output by said solar cells.

2. A self-luminous buoy comprising:

a. an axially elongated, generally hexagonal body adapted to float in water with said axis generally parallel with the water surface, having a passageway extending coaxially therethrough to slidably receive a flexible line therewithin so that said buoy can rotate about said axis defined by said line in response to wave motion while floating on water;

b. a plurality of solar cells positioned as a first annular array about said axis, for generating electricity when contacted by sunlight, located on respective outwardly facing surface of said hexagonal body;

c. a battery, within said body, for storing electrical energy generated by said solid cells;

d. light-emitting elements configured as a second annular array about said axis and positioned at juncture of adjacent ones of said outwardly facing surfaces of said body for emitting light in response to electrical energy furnished by said battery;

e. light reflecting plates surrounding said light-emitting elements, formed and recessed within said body at juncture of adjacent ones of said outwardly facing surfaces, for reflecting light emitted by said elements outwardly from said buoy as said light-emitting elements and said light reflecting plates rotate unitarily with and as a part of said buoy about said horizontal axis in response to wave motion;

f. means, within said body, for providing electrical energy from said battery to said light-emitting elements upon ambient light reaching a predetermined low level;

g. a cyndrical transparent synthetic resin shell about and secured to said body, having holes therethrough corresponding to ends of said passageway for passage of said line therethrough.

* * * * *